United States Patent [19]

Teichert

[11] 4,314,222

[45] Feb. 2, 1982

[54] THERMOSTAT ANTICIPATOR IMPROVEMENTS

[75] Inventor: Allen L. Teichert, Placentia, Calif.

[73] Assignee: Robertshaw Controls Company, Richmond, Va.

[21] Appl. No.: 81,545

[22] Filed: Oct. 3, 1979

[51] Int. Cl.[3] ..... H01H 37/14

[52] U.S. Cl. ..... 337/107; 338/179

[58] Field of Search ..... 337/102, 103, 107, 108; 338/176, 179, 117; 236/68 B

[56] References Cited

U.S. PATENT DOCUMENTS

| | | | |
|---|---|---|---|
| 2,092,327 | 9/1937 | Persons | 337/103 |
| 2,847,536 | 8/1958 | Bishop | 337/103 |
| 3,316,374 | 4/1967 | Nelson | 337/107 |
| 3,339,043 | 8/1967 | Baak | 337/103 |
| 3,723,938 | 3/1973 | Gramm | 338/176 |
| 4,115,750 | 9/1978 | Hansen et al. | 337/107 |

*Primary Examiner*—William H. Beha, Jr.
*Attorney, Agent, or Firm*—Fulwider, Patton, Rieber, Lee & Utecht

[57] ABSTRACT

There is disclosed an improved anticipator construction for a space heating and/or cooling thermostat in which a heat conductor is positioned in contact with the anticipator resistor heater with a portion thereof in heat exchange relationship to the bimetallic switch actuator of the thermostat. The preferred embodiment includes an elongated resistive heater having a non-linear resistance along its length with a moveable contact mounted within the thermostat for providing a fixed adjustability in the resistance of the resistive heater. The non-linear resistance of the resistive heater compensates, at least partly, for the exponential heat release response with variation in resistance of the resistive heater, thereby providing an expanded range of applications of the thermostat.

3 Claims, 7 Drawing Figures

FIGURE 1
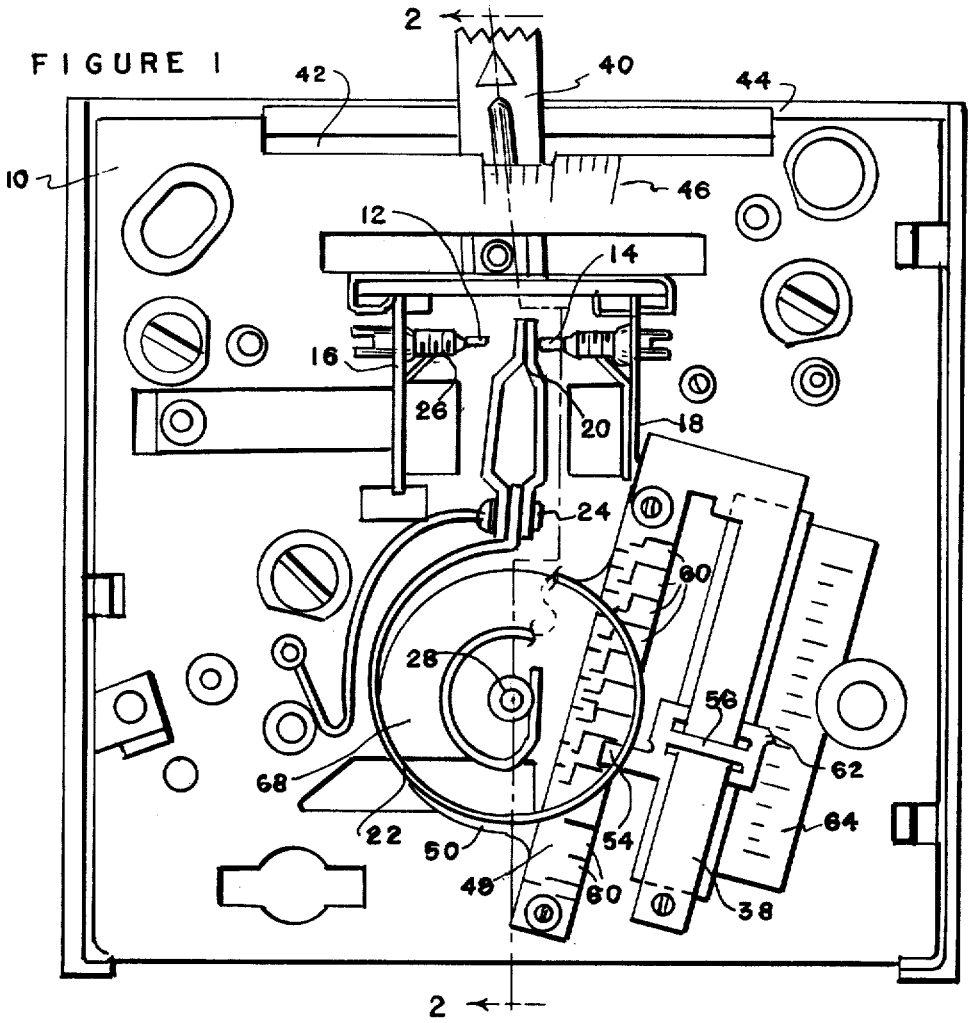
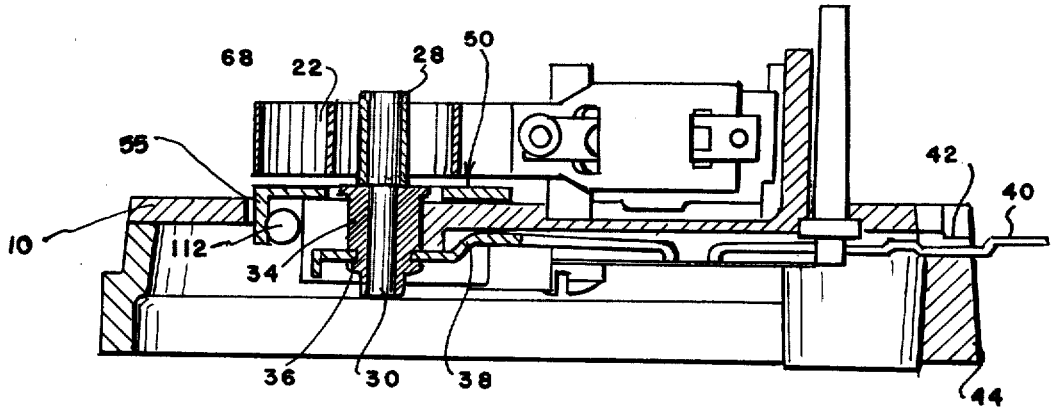
FIGURE 2

THERMOSTAT ANTICIPATOR IMPROVEMENTS

BACKGROUND OF THE INVENTION

1. Field of Invention

This invention relates to space thermostats and, in particular, to space thermostats having anticipator circuits for the heating and/or cooling cycles.

2. Brief Statement of the Prior Art

Space thermostats typically have a bimetallic switch operator such as a bimetallic helical coil to open and close the thermostat in response to ambient temperature changes. The thermostats have, for many years, included anticipator circuits in which a resistive heating element is included within the thermostat housing in circuit with the thermostat contacts to release heat to the thermostat housing, raising the bimetallic switch actuator slightly above the ambient temperature and thereby anticipating the temperature rise which occurs after opening of the thermostat contacts and discontinuance of the heating cycle from inertia of the heating system.

The most commonly employed heating resistor is a small diameter wire conductor with a slidable contact moveable along its length to provide fixed adjustability in the value of the heating resistor.

A difficulty with the conventional anticipator construction is that the heat transfer between the resistance heater and the bimetallic switch actuator has, heretofore, depended on juxtapositioning these elements. The inefficient heat transfer between these members requires a substantial release of heat to the thermostat housing for adequate anticipation and the amount of heat so released often can not be dissipated during the portion of the heating cycle when the anticipator circuit is open. The resultant performance has been referred to as "droop". The slide wire variable resistor heating element also can burn out if the slide wire contact is incorrectly positioned for the particular application. Finally, the slide wire resistance heater provides a linear or constant value of resistivity along its length and the non-linear heat release of the anticipator results in a non-linear or geometrical scale for the slide contact, greatly decreasing the useful application range of the instrument.

BRIEF DESCRIPTION OF THE INVENTION

This invention comprises an anticipator for a space thermostat in which the resistive heating element of the anticipator is in contact with a portion of a heat conductor having another portion thereof in heat exchange relationship to the bimetallic actuator of the thermostat. This construction greatly improves the thermal efficiency of the anticipator circuit, reducing droop of the instrument and reducing unintentional burnout of the resistive heater. In the preferred embodiment, the resistive heating element is an elongated member with a moveable slide contact to provide fixed adjustability in the value of its resistance. Most preferably, the elongated resistive element has a specific resistivity which varies geometrically along its length in a manner compensating for the non-linear heat release response of the element, thereby, greatly expanding the useful application range of the instrument and increasing the linearity of the scale associated with the moveable contact of the anticipator resistor.

BRIEF DESCRIPTION OF THE DRAWINGS

The invention will be described with reference to the FIGURES of which:

FIG. 1 is a plan view of the front of a thermostat including the anticipator means of the invention;

FIG. 2 is a view along lines 2—2 of FIG. 1;

DESCRIPTION OF PREFERRED EMBODIMENT

Figure 7:
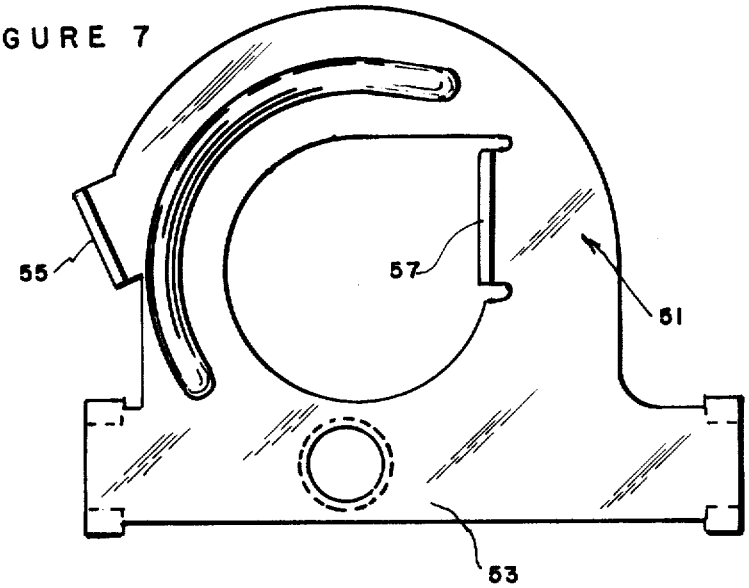
FIG. 7 is a plan view of a configuration for a heat conductor useful in the invention.

Referring now to FIG. 1, a typical thermostat modified in accordance with the invention is shown with its front cover removed. The thermostat has a base plate 10 and a coverplate, not shown. The thermostatic switch has stationary contacts 12 and 14 which are carried on upright brackets 16 and 18. The moveable switch contact 20 is mounted on the free end of a bimetallic coil 22, being attached thereto by rivet 24. The stationary contacts 12 and 14 have threaded shanks such as 26, that are received in a threaded aperture of their mounting brackets whereby the spacing between contacts 12 and 14 is fixedly adjustable.

The bimetallic coil 22 is secured to a sleeve 28 which is carried on shaft 30; see FIG. 2. Shaft 30 is received in bushing 32 in a friction fit and the bushing is rotatably supported in aperture 34 of the baseplate 10 of the thermostat. Bushing 32 has an annular groove 36 which receives the end of lever 38. Lever 38 has a distal portion 40 that projects through a slot 42 in the sidewall 44 of the plate 10 to provide an external lever for adjustment of the position of the helical bimetallic coil 22 in the assembly. As conventional for thermostats, a calibrated scale 46 of indicia is provided to register the set temperature of the thermostat.

Figure 3:
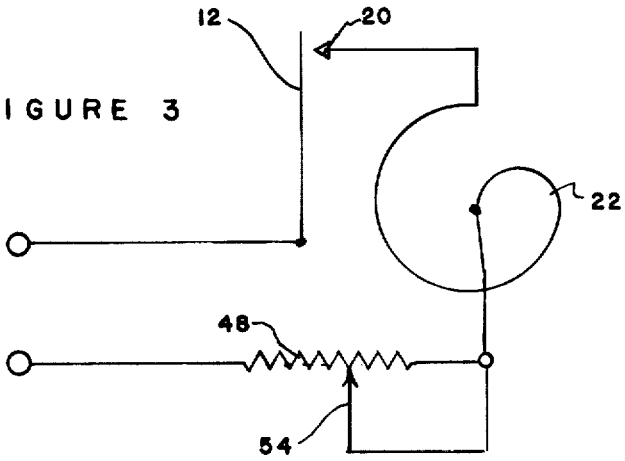
FIG. 3 is an electrical schematic of an anticipator circuit.

As shown in FIG. 3, the typical thermostat circuit includes at least one stationary contact 12, the moveable contact 20 carried by the bimetallic actuator 22 and the anticipator resistor 48, typically in series therewith.

Referring again to FIG. 1, the anticipator improvements of the invention include the elongated variable resistor 48 used as the resistive heating element of the anticipator and the heat conductor 50. The latter comprises a disc of a suitable thermal conductor such as metal which is positioned with a major portion 68 of its area located immediately beneath the bimetallic helical coil 22 and which has another portion 52 located in heat exchange relationship to the resistive heating element 48. In the illustrated configuration, the disc 50 is bonded with portion 52 to the undersurface of the resistive heating element 48.

As shown in FIG. 3, the anticipator resistive heating element 48 is a variable resistor, having a moveable contact 54 whereby the resistive value of this element is fixedly adjustable. The moveable contact 54 is shown in FIG. 1 is carried on slide 56 which is slidably mounted on elongated bar 58 that serves as a track for slide 56. As slide 56 is moved along bar 58, the moveable contact 54 makes contact with one of a plurality of spaced contacts 60 which are located along the length of the variable resistive element 48. Slide 56 also has a pointer 62 which cooperates with a plurality of calibrated indicia 64 to reflect the current flow through the resistive heating element. As shown, a typical current flow for the anticipator of the invention is from about 0.15 to about 1.2 amps.

Figure 4:
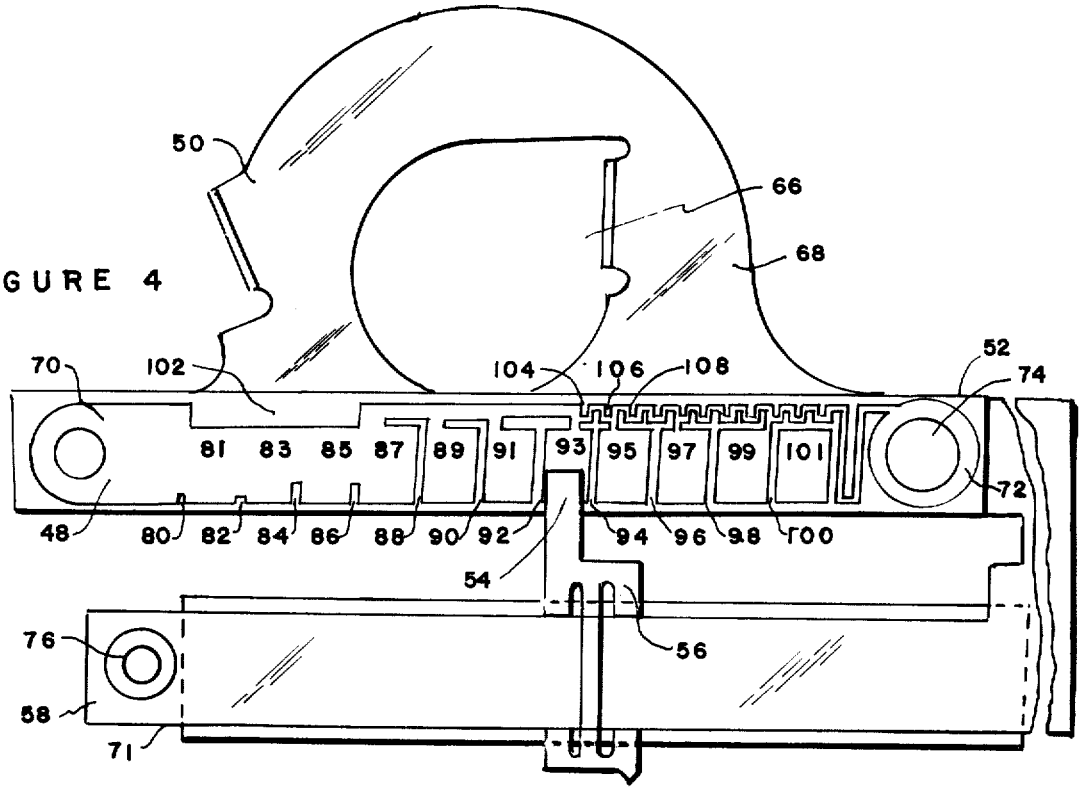
FIG. 4 is an enlarged detail of the anticipator assembly of FIG. 1.

The anticipator construction is shown in greater detail in FIG. 4 which is an enlarged view of the anticipator and heat conductor elements. The heat conductor 50 is shown as a flat disc like member having an aperture 66 centrally located in the portion 68 that is positioned beneath and in heat conducting relationship to the bimetallic helical coil 22, shown in FIG. 1. The heat conductor also has an elongated bar 52 which supports the resistive element 48 of the anticipator. Bar 52, together with L-shaped bracket 71 form a U-shaped assembly with bar 58 of bracket 71 serving as the track for the slide 56. The bracket 71 has apertures 74, and 76, which receive rivets such as 72 to secure the assembly to the base 10 of the thermostat. The elongated resistive element 48 is bonded to the upper surface of bar 52. This resistive heating element comprises a thin layer of an electrically conductive metal, preferably a layer of nickel alloy which is etched into an elongated conductor in the form of a ribbon conductor having a tortuous path. The conductor is bonded to an insulating film of material such as polyimide film, which is then cemented to the heat conductor. The tortuous path is defined in the sheet conductor by etching of the sheet to provide a plurality of open spaces such as slots 80, 82, 84, 86, 88, 90, 92, 94, 96, 98 and 100, which provide therebetween a plurality of equally spaced contact pads 81, 83, 85, 87, 89, 91, 93, 95, 97, 99 and 101. Each of these sequential pads is in contact with a successively greater length, and hence resistance, of the ribbon conductor. The length of the conductor is additionally increased by a plurality of intermediate relieved portions 102, 104, 106 and 108, etc., which provide a tortuous path of the ribbon conductor.

The last contact pad 101 is isolated from contact with the ribbon conductor so that the slide can be moved in contact with this pad and out of contact with the ribbon conductor and the circuit through the anticipator heating element 48 includes the entirety of the conductor, providing maximum resistance and minimum current flow.

The cross-sectional area of the conductor path is decreased along the length of resistor 48, increasing its resistance in a non-linear fashion along its length, the resistance thus increasing exponentially with the linear distance along resistor 48. This is achieved in the embodiment of FIGS. 1 and 4 by increasing the frequency and length of the etched portions along the linear length of the resistor 48. The resistivity of the path of the resistive heating element 48 thus increases exponentially with distance. This construction expands the scale of the linear conductor and offsets, to a significant extent, the non-linearity in the heating response of the anticipator heating element 48.

Figure 5:
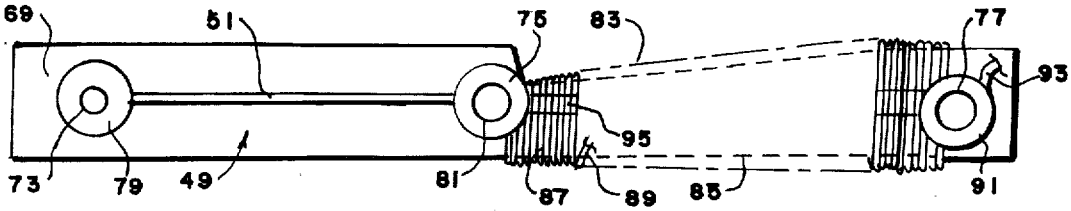
FIG. 5 is a plan view of an alternative anticipator for the invention.
Figure 6:
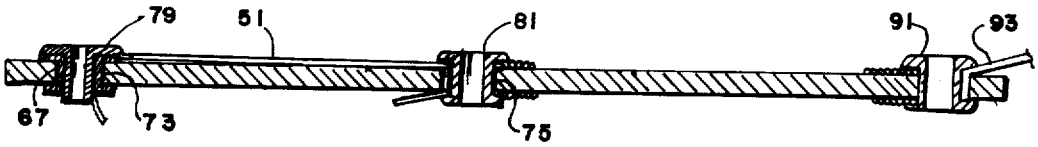
FIG. 6 is a view along lines 5—5 of FIG. 5.

Referring now to FIGS. 5 and 6, there is illustrated an alternative form of the resistive heating element for the anticipator. As there illustrated, the heating element is mounted on a longitudinal bar 69 which has a plurality of apertures 73, 75 and 77 for receiving rivets which can be used to mount the bar 69 to the supporting base of the thermostat. The particular resistive heating element 49, which is illustrated, includes a short length 51 of a wire conductor which extends between terminating rivets 79 and 81 which are received in the apertures in bar 69. This particular construction is better illustrated in FIG. 6 wherein the rivets 79 and 81 are shown, the former received within a rivet 67 in aperture 73 and the latter in aperture 75, respectively of bar 69. The wire conductor 51 is shown with a short length, at each end, also disposed within the apertures and secured thereto by rivets.

Bar 69 has a relieved edge portion 83 along the second portion 85 of its length. A continuous winding 87 of a wire conductor 89 is wrapped about the second portion 85 of the bar 69. Since the relieved portion 85 progressively increases in width along its length, each successive winding of the coil 87 has a progressively greater length, and hence, a progressively greater resistance per winding. In this manner, the resistivity of the windings can be progressively increased in a linear or, if desired, in an exponential fashion, dependent entirely on the angle or curvature of the inset relieved portion 85.

The end of the conductor 89 is terminated at eyelet 91 which is inserted in the end aperture 77 of bar 69 and this eyelet is also connected to the conductor 93 of the thermostat.

The wire conductor 89 bears electical insulation along its entire length and, after the windings 87 are assembled on the bar 69, the insulation is removed by physical and/or chemical treatment along a band 95 which extends across the windings 87 to provide exposed portions of the wire conductor 89 for contact by the contact 54 of a slider such as slider 56 as shown in FIGS. 1 and 4.

The resistive heating member 49 of the anticipator shown in FIGS. 5 and 6 is combined with the heat conductor 51 that is shown in FIG. 7. This heat conductor has a semi-circular thin disc portion which underlies the bimetallic helical coil 22 of the thermostat and which has portion 53 for mounting in heat exchange relationship to the resistive heating element 49; the portion 53 being physically beneath bar 69 and in direct contact therewith. The disc 51 has tabs 55 and 57 which project downwardly through the base 10 of the thermostat (see FIG. 2) so as to be in contact with other resistive heating elements which can be used in other portions of the thermostat cycle. These resistive heating elements such as 112 are in thermostats which provide for control of refrigeration or air conditioning units during the cooling cycles. Typically, these resistive heating elements are in circuit to a potential during the off periods of the cooling cycle to release heat to the interior of the thermostat housing, anticipating the increase in ambient temperature and, hence, providing an anticipator demand signal for refrigeration.

The thermostat anticipator improvements of the invention provide a number of advantages over prior constructions. The danger that resistive heating element of the anticipator may burn out if the slide is improperly located is substantially reduced, since the heat conductor provides a very efficient sink and heat dissipator for the heating element. The greater efficiency of heat transfer permits a thermostat to have a much broader range of applications with the variations in circuit amperages and still provide a desirable constant wattage with the resulting satisfactory degree of anticipation for varied applications, such as providing a single thermostat unit for a complete furnace line of a manufacturer as well as providing a thermostat which can be adapted to a wide variety of applications, e.g., use in relay circuits wherein the thermostat receives a relatively low amperage current supply or in applications for direct actuation of the gas valve of an appliance where a much greater current supply is received by the thermostat. The thermostat anticipator is also provided with a more linear scale, thereby insuring a greater sensitivity in the scale adjustability throughout the entire range of the resistive heating element. Since the heat conductor employed with the anticipator provides a more efficient heat transfer, the thermostat exhibits less droop than prior thermostats.

The invention has been described with reference to the illustrated and presently preferred embodiment. It is not intended that the invention be unduly limited by this description of the presently preferred embodiment. Instead, it is intended that the invention be defined by the means, and their obvious equivalents, set forth in the following claims.

What is claimed is:

1. In a thermostat having a temperature responsive switch and a bimetallic actuator therefor, and an anticipator circuit for heating said bimetallic actuator during a preselected one of on or off periods of said temperature responsive switch, the improvement comprising:

a metal radiator positioned with a major portion of its area located immediately beneath said bimetallic actuator in direct heat exchange contact with said resistive heating element, and said radiator is bonded to a U-shaped assembly with a first bar located proximate to said metal radiator and a second slide bar parallel thereto, a resistive heating element mounted on said first bar and including a thin metallic ribbon resistive conductor adhesively bonded to said first bar by an insulating film, and at least a portion of which is located immediately beneath said bimetallic actuator, said resistive conductor providing a plurality of electrical pads spaced at substantially equal increments along its length and separated by an equal plurality of open areas spaced along its length to provide a preselected decrease in the cross-sectional area of said resistive conductor, and a wiper arm is slidably carried on said slide bar with a contact arm extending into electrical contact with said resistive element, whereby movement of said wiper arm along said slide bar provides a resistivity which increases nonlinearly with distance along the length of said resistive conductor, and said metal radiator heats said bimetallic actuator accordingly.

2. The thermostat of claim 1 wherein said bimetallic actuator is a helical coil.

3. A thermostat according to claim 1 in which said metal radiator includes a disk located immediately beneath said bimetallic actuator, and said metal radiator is bonded with said first bar to the undersurface of said resistive heating element.

* * * * *